US006967071B2

(12) United States Patent
Dickerson et al.

(10) Patent No.: US 6,967,071 B2
(45) Date of Patent: Nov. 22, 2005

(54) HIGH SPEED RADIOGRAPHIC IMAGING ASSEMBLY

(75) Inventors: Robert E. Dickerson, Hamlin, NY (US); Phillip C. Bunch, Rochester, NY (US); David J. Steklenski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/958,736

(22) Filed: Oct. 5, 2004

(65) Prior Publication Data

US 2005/0100838 A1 May 12, 2005

Related U.S. Application Data

(63) Continuation-in-part of application No. 10/706,340, filed on Nov. 12, 2003, now abandoned, and a continuation-in-part of application No. 10/706,010, filed on Nov. 12, 2003, now abandoned.

(51) Int. Cl.[7] ..... G03C 1/035; G03C 1/46; G03C 5/17

(52) U.S. Cl. ..... 430/139; 430/502; 430/509; 430/966

(58) Field of Search ..... 430/139, 502, 430/509, 966

(56) References Cited

U.S. PATENT DOCUMENTS

| | | | | |
|---|---|---|---|---|
| 4,425,425 | A | 1/1984 | Abbott et al. | |
| 4,425,426 | A | 1/1984 | Abbott et al. | |
| 4,713,320 | A | 12/1987 | Maskasky | |
| 4,713,323 | A | 12/1987 | Maskasky | |
| 4,914,014 | A | 4/1990 | Daubendiek et al. | |
| 5,430,302 | A | 7/1995 | Torardi | |
| 5,432,351 | A | 7/1995 | Pesce et al. | |
| 5,461,660 | A | 10/1995 | Dooms et al. | |
| 5,746,943 | A | 5/1998 | Torardi | |
| 5,888,647 | A | 3/1999 | Yamane | |
| 5,998,083 | A | 12/1999 | Verbeeck et al. | |
| 6,190,822 | B1 * | 2/2001 | Dickerson et al. | 430/139 |
| 6,350,554 | B1 * | 2/2002 | Dickerson et al. | 430/139 |
| 6,361,918 | B1 * | 3/2002 | Dickerson et al. | 430/139 |
| 6,387,586 | B1 * | 5/2002 | Dickerson et al. | 430/139 |

(Continued)

FOREIGN PATENT DOCUMENTS

| | | |
|---|---|---|
| EP | 0 690 342 B1 | 1/1996 |
| EP | 0 581 065 B1 | 10/1999 |
| EP | 1 203 985 A | 5/2002 |

OTHER PUBLICATIONS

"Improvement in the Image Quality of Cerebral Angiograms" by Rossmann et al, *Radiology* vol. 96, pp. 361-365, Aug., 1970.

(Continued)

*Primary Examiner*—Richard L. Schilling
(74) *Attorney, Agent, or Firm*—J. Lanny Tucker

(57) ABSTRACT

An ultra-high-speed radiographic imaging assembly (at least 900 system speed) is useful especially for pediatric radiography to provide images with improved contrast and sharpness and reduced fog. The imaging assembly includes a symmetric film having a speed of at least 400 that includes at least two silver halide emulsion layers on each side of a film support that comprise tabular silver halide grains. The imaging assembly also includes two fluorescent intensifying screens wherein the pair of screens has a screen speed of at least 400 and the screens have an average screen sharpness measurement (SSM) value greater than reference Curve A of FIG. 4. The screens can have a support that includes a reflective substrate comprising a continuous polyester phase and microvoids containing inorganic particles dispersed within the polyester phase.

18 Claims, 4 Drawing Sheets

U.S. PATENT DOCUMENTS

| | | | | |
|---|---|---|---|---|
| 6,394,650 | B1 | 5/2002 | Ohara et al. | |
| 6,682,868 | B1 * | 1/2004 | Dickerson et al. | 430/139 |
| 6,686,115 | B1 | 2/2004 | Dickerson et al. | |
| 6,686,116 | B1 | 2/2004 | Dickerson et al. | |
| 6,686,117 | B1 | 2/2004 | Dickerson et al. | |
| 6,686,118 | B1 | 2/2004 | Davis et al. | |
| 6,686,119 | B1 | 2/2004 | Pavlik et al. | |
| 2001/0031418 | A1 | 10/2001 | Taguchi | |
| 2002/0155373 | A1 | 10/2002 | Dickerson et al. | |
| 2003/0138722 | A1 | 7/2003 | Taguchi | |

OTHER PUBLICATIONS

"Comparison of High-MTF and Reduced-noise Radiographic Imaging Systems" by Phillip C. Bunch, SPIE vol. 2432, May 1995.

JP Abstract 2001-613463/71.

JP Abstract 2002-413377/44.

JP Abstract 2004-223747/21.

U.S. Appl. No. 10/706, 340 (D-84504) filed Nov. 12, 2003, by Dickerson et al., titled *Ultra-High-Speed Radiographic Film, Imaging Assembly, And Method*.

U.S. Appl. No. 10/706,010 (D-84505) filed Nov. 12, 2003, by Dickerson et al., titled *Ultra-High-Speed Radiographic Film, Imaging Assembly, And Method To Provide Sharp Images*.

U.S. Appl. No. 10/706,667 (D-84506) filed Nov. 12, 2003, by Dickerson et al., titled *High Speed General Purpose Radiographic Film To Provide Sharp Images*.

U.S. Appl. No. 10/958,737 (D-84506A) filed herewith, by Dickerson et al., titled *High Speed Radiographic Film*.

U.S. Appl. No. 10/706,655 (D-84507) filed Nov. 12, 2003, by Dickerson et al., titled *High Speed Imaging Assembly For General-Purpose Radiography*.

U.S. Appl. No. 10/712,389 (D-84508) filed Nov. 12, 2003, by Dickerson et al., titled *High Speed Imaging Assembly For General-Purpose Radiography*.

U.S. Appl. No. 10/706,191 (D-84509) filed Nov. 12, 2003, by Dickerson et al., titled *Imaging Assembly For Orthopedic Radiography*.

U.S. Appl. No. 10/706,529 (D-84276) filed Nov. 12, 2003, by Dickerson et al., titled *Ultrahigh Speed Imaging Assembly For General-Purpose Radiography*.

U.S. Appl. No. 10/958,785 (D-84276A) filed herewith, by Dickerson et al., titled *Ultrahigh Speed Imaging Assembly For Radiography*.

U.S. Appl. No. 10/706,574 (D-84277) filed Nov. 12, 2003, by Dickerson et al., titled *Ultrahigh Speed Imaging Assembly For Orthopedic Radiography*.

U.S. Appl. No. 10/958,738 (D-84277A) filed herewith, by Dickerson et al., titled *High Speed Imaging Assembly For Radiography*.

Online! XP002317613 "Products by Use Medical Radiography" Retrieved from Internet, dated Apr. 5, 2005.

* cited by examiner

HIGH SPEED RADIOGRAPHIC IMAGING ASSEMBLY

RELATED APPLICATIONS

This application is related to and commonly assigned Continuation-in-part applications U.S. Ser. No. 10/706,340 now abandoned and Ser. No. 10/706,010 now abandoned, both filed Nov. 12, 2003.

FIELD OF THE INVENTION

This invention is directed to radiography. In particular, it is directed to a high speed radiographic imaging assembly that provides improved medical diagnostic images at lower dosage especially for pediatric radiography. For example, the invention is useful in the diagnostic evaluation of scoliosis or other conditions requiring low-dosage imaging.

BACKGROUND OF THE INVENTION

In conventional medical diagnostic imaging, the object is to obtain an image of a patient's internal anatomy with as little X-radiation exposure as possible. The fastest imaging speeds are realized by mounting a duplitized radiographic element between a pair of fluorescent intensifying screens for imagewise exposure. About 5% or less of the exposing X-radiation passing through the patient is adsorbed directly by the latent image forming silver halide emulsion layers within the duplitized radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.), U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and U.S. Pat. No. 5,576,156 (Dickerson), and *Research Disclosure*, Vol. 184, August 1979, Item 18431.

Problem to be Solved

Image quality and radiation dosage are two important features of film-screen radiographic combinations (or imaging assemblies). High image quality (that is, high resolution or sharpness) is of course desired, but there is also the desire to minimize exposure of patients to radiation. Thus, "high speed" radiographic films are needed. However, in known radiographic films, the two features generally go in opposite directions. Thus, imaging assemblies that can be used with low radiation dosages (that is, "high speed" assemblies) generally provide images with poorer image quality (poorer resolution). Lower speed imaging assemblies generally require higher radiation dosages.

Conventional radiographic film-screen combinations, known as imaging assemblies (or systems), useful for general radiography, generally have a total system speed of less than 400. The use of higher speed films in such assemblies may not be useful because of higher fog or unwanted density in the non-imaged areas of the film, or loss in sharpness or resolution.

There is a need for higher speed imaging assemblies useful especially for pediatric radiography that require minimum radiation dosages with minimal sacrifice in image quality (for example, maintaining image resolution or sharpness).

SUMMARY OF THE INVENTION

This invention provides a radiographic imaging assembly that has a system speed of at least 700 and comprises:

A) a symmetric radiographic silver halide film having a film speed of at least 400 and comprising a support that has first and second major surfaces, the radiographic silver halide film having disposed on the first major support surface, one or more hydrophilic colloid layers including a first silver halide emulsion layer, and having on the second major support surface, one or more hydrophilic colloid layers including a second silver halide emulsion layer, and B) a fluorescent intensifying screen arranged on each side of the radiographic silver halide film, the pair of screens having a screen speed of at least 400 and the screens having an average screen sharpness measurement (SSM) value greater than reference Curve A of FIG. 4, and each screen comprising an inorganic phosphor capable of absorbing X-rays and emitting electromagnetic radiation having a wavelength greater than 300 nm, the inorganic phosphor being coated in admixture with a polymeric binder in a phosphor layer on a support.

In preferred embodiments, a radiographic imaging assembly that has a system speed of at least 1000, comprises:

A) a symmetric radiographic silver halide film having a film speed of at least 900 and comprising a support that has first and second major surfaces, the radiographic silver halide film having disposed on the first major support surface, two or more hydrophilic colloid layers including a first silver halide emulsion layer, and having on the second major support surface, two or more hydrophilic colloid layers including a second silver halide emulsion layer, each of the first and second silver halide emulsion layers comprising tabular silver halide grains that have the same composition, independently an aspect ratio of from about 38 to about 45, an average grain diameter of at least 3.5 $\mu$m, and an average thickness of from about 0.08 to about 0.14 $\mu$m, and comprise at least 95 mol % bromide and up to 1 mol % iodide, both based on total silver in the grains, the film further comprising a protective overcoat on both sides of the support disposed over all of the hydrophilic colloid layers, wherein the tabular silver halide grains in the first and second silver halide emulsion layers are dispersed in a hydrophilic polymeric vehicle mixture comprising from about 5 to about 15% of deionized oxidized gelatin, based on the total dry weight of the hydrophilic polymeric vehicle mixture, and B) a fluorescent intensifying screen arranged on each side of the radiographic silver halide film, the pair of screens having a screen speed of at least 600 and the screens having an average screen sharpness measurement (SSM) value that is at least 1.1 times that of reference Curve A of FIG. 4 at a given spatial frequency, and each screen comprising a terbium activated gadolinium oxysulfide phosphor capable of absorbing X-rays and emitting electromagnetic radiation having a wavelength greater than 300 nm, the phosphor being coated in admixture with a polymeric binder in a phosphor layer on a flexible polymeric support.

This invention also provides a method of providing a black-and-white image comprising exposing the radiographic silver halide film in a radiographic imaging assembly of the present invention and processing the film, sequentially, with a black-and-white developing composition and a fixing composition. The resulting black-and-white images can be used for a medical diagnosis.

In particular, the present invention provides high contrast and very sharp images using an imaging assembly that has very high system photographic speed (at least 700, preferably at least 1100, and more preferably at least 1400). The imaging assembly can be particularly useful for pediatric radiography or other instances where it is particularly necessary to limit patient exposure to X-radiation.

In addition, all other desirable sensitometric properties are maintained and the radiographic film of the imaging assembly can be rapidly processed in conventional processing equipment and compositions.

These advantages are achieved by using a novel combination of a high speed symmetric radiographic silver halide film (at least 400 film speed) and a pair of high speed fluorescent intensifying screens (at least 400 screen speed) arranged on opposing sides of the film. The symmetric radiographic silver halide film preferably has unique silver halide emulsion layers comprising tabular silver halide grains having specific halide compositions, grain sizes, and aspect ratios to achieve the desired film speed. In more preferred embodiments, the tabular grains in all emulsion layers are dispersed in a hydrophilic polymeric vehicle mixture that includes at least 0.05 weight % of oxidized gelatin (based on total dry weight of the hydrophilic polymeric vehicle mixture). With the unique choice of fluorescent intensifying screen and radiographic film of this invention, images with increased sharpness can be obtained at high speeds (thus, at lower radiation dosage). Such image quality improvements can be characterized by screen SSM values being greater than the values represented by reference Curve A of FIG. 4 over the range of spatial frequencies. In some preferred embodiments, image quality improvements can be characterized by screen SSM values being greater than the values represented by reference Curve A of FIG. 5 over the range of spatial frequencies.

Further advantages are provided in preferred embodiments with a specific microvoided reflective substrate in the flexible support of the fluorescent intensifying screen used in the imaging assembly. Within the microvoids are suitable reflective inorganic particles, and especially particles of barium sulfate. As a result, this screen has increased reflectivity to electromagnetic radiation, especially radiation in the region of from about 350 to about 450 nm.

DETAILED DESCRIPTION OF THE INVENTION

Figure 1:
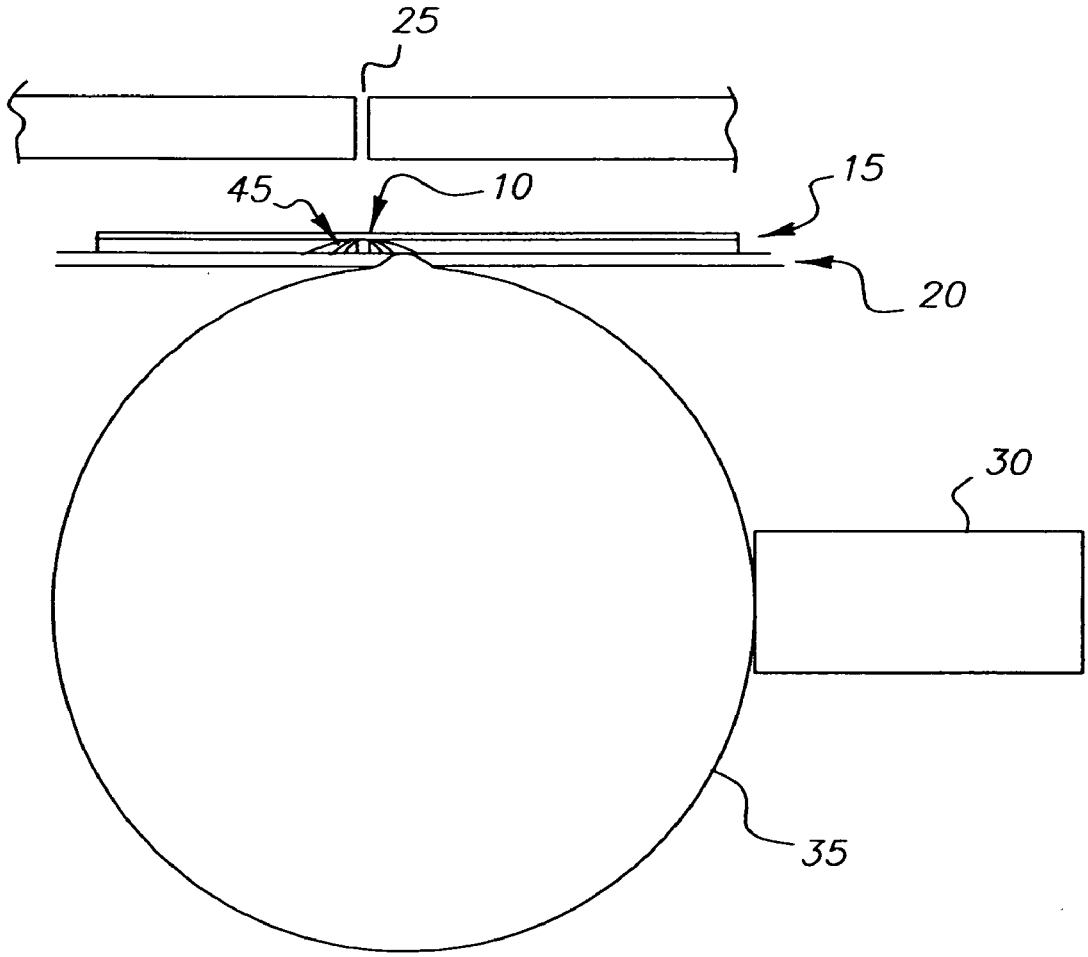
FIG. 1 is a simplified schematic representation of a test system used to determine SSM values.

Definition of Terms:

Unless otherwise indicated, the terms "radiographic imaging assembly" and "imaging assembly" refer to embodiments of the present invention.

The term "contrast" as herein employed refers to the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)$\div\Delta\log_{10}E$ ($\log_{10}E_2-\log_{10}E_1$), $E_1$ and $E_2$ being the exposure levels at the reference points (1) and (2).

"Gamma" is used to refer to the instantaneous rate of change of a density vs. loge sensitometric curve (or instantaneous contrast at any loge value).

"System speed" refers to a measurement given to combinations ("systems" or imaging assemblies) of radiographic silver halide films and fluorescent intensifying screens that is calculated using the conventional ISO 9236-1:1996(E) standard wherein the radiographic film is exposed and processed under the conditions specified in Eastman Kodak Company's Service Bulletin 30. In general, system speed is thus defined as 1 milliGray/$K_s$ wherein Ks is Air Kerma (in Grays) required to achieve a density=1.0+$D_{min}$+fog. In addition, 1 milliRoentgen (mR) is equal to 0.008732 milliGray (mGray). For example, by definition, if 0.0025 milliGray (equal to 0.286 mR) incident on a film-screen system creates a density of 1.0 above $D_{min}$+fog, that film-screen system is considered to have a speed of "400".

However, the ISO speed depends on the x-ray spectrum, and is different for the four ISO conditions. It is common to use a "scaled" version of system speed, wherein Radiographic Film A described below used in combination with a pair of fluorescent intensifying screens identified as "X" below, when exposed with an 80 kV (constant potential) X-ray spectrum, filtered with 0.5 mm copper and 1 mm aluminum, at an exposure duration of approximately 0.15 seconds, is assigned or designated a speed value of 400.

The ISO condition four speed for this system is approximately 500. Thus, the relationship between the ISO condition four speed value and the definition of system speed used in this application is approximately the ratio 500/400=1.25. That is, the numerical values of the system speed in this application are 0.80 times those directly obtained using equation 7.1 of the noted ISO 9236-1:1996E) standard. Thus, the "scaled" system speed values are used in this application. However, they can be converted to ISO speed values by dividing them by 0.80.

In this application, "film speed" has been given a standard of "400" for Radiographic Film A described in Example 1 below, that has been exposed for approximately 0.15 second and processed according to conditions shown in Example 1, using a pair of fluorescent intensifying screens containing a terbium activated gadolinium oxysulfide phosphor (such as Screen "X" noted below). Thus, if the Ks value for a given system using a given radiographic film is 50% of that for a second film with the same screen and exposure and processing conditions, the first film is considered to have a speed 200% greater than that of the second film.

Also in this application, "screen speed" has been given a standard of "400" for a pair of screens identified below as Screen "X", each screen containing a terbium activated gadolinium oxysulfide phosphor. Thus, if the $K_s$ value for a given system using a given screen pair with a given radiographic film is 50% of that for a second screen pair with the same film and exposure and processing conditions, the first screen pair is considered to have a speed 200% greater than that of the second screen pair.

The "screen speed" values noted herein are in reference to a pair of screens (either symmetric or asymmetric) arranged on opposing sides of a radiographic film.

The "screen sharpness measurement" (SSM) described herein is a parameter that has been found to correlate well with visual appearance of image sharpness if other conditions are held constant.

Each screen sharpness measurement described in this application was made using a test system that is described as follows and as illustrated in FIG. 1. A slit-shaped X-ray exposure 10 was made onto phosphor screen sample 15 (in a front-screen configuration) that was in contact with optical slit 20. The profile or spread 45 of the emitted light from the screen was determined by scanning optical slit 20 relative to X-ray slit (or mask) 25 and digitizing the resulting signal. Photomultiplier tube 30 (PMT) was used to detect the light that passed through optical slit 20. Data processing was done during acquisition and analysis to minimize noise in the resulting light spread profile (LSP). A Fourier transform of the LSP was calculated to give the SSM as a function of spatial frequency.

In FIG. 1, a very narrow tungsten carbide mask (10–15 $\mu$m wide, about 0.64 cm thick, and about 0.64 cm long) was used as X-ray slit 25 to provide slit-shaped X-ray exposure 10. X-ray slit 25 was held fixed with respect to the source of X-radiation. Phosphor screen sample 15 was placed face down (exit surface) on top of optical slit 20 made of two pieces of sharpened tool steel. The steel had been darkened by a chemical treatment and further blackened by a black felt-tipped pen. Phosphor screen sample 15 was held in place by a piece of a carbon fiber cassette panel (not shown) that was held down by pressure from spring-loaded plungers (not shown). The light passed through optical slit 20 was collected by integrating sphere 35 and a fraction of it was then detected by PMT 30. The whole assembly of phosphor screen sample 15, optical slit 20, integrating sphere 35, and PMT 30 was translated relative to X-ray slit 25. Optical slit 20 was aligned with X-ray slit 25. As phosphor screen sample 15 was passed under X-ray slit 25, the light that passed through optical slit 20 varied according to the profile of lateral light spread within phosphor screen sample 15.

Any suitable source of X-radiation can be used for this test. To obtain the data described in this application, the X-radiation source was a commercially available Torrex 120D X-Ray Inspection System. Inside this system, the linear translation table that holds the entire assembly was under computer control (any suitable computer can be used). Integrating sphere 35 had a 4-inch (10.2 cm) diameter and was appropriately reflective. One such integrating sphere can be obtained from Labsphere. The top port of integrating sphere 35 that accepted the light from optical slit 20 was 1 inch (2.54 cm) in diameter. The side port that was used for PMT 30 was also 1 inch (2.54 cm) in diameter. While any suitable PMT can be used, we used a Hamamatsu 81925 with a quartz window for extended UV response. It was about 1 inch (2.54 cm) in diameter, and had a very compact dynode chain so the length of the PMT was minimized. High voltage was supplied to PMT 30 by a 0–1 kV power supply (not shown). A transimpedence amplifier (not shown) having a simple single RC bandwidth limitation of around 1 kHz was constructed. The signal from PMT 30 was low-pass filtered using a 24 dB/octave active filter set at a bandwidth of about 300 Hertz. A suitable computer system (for example, an Intel 486DX-33 MHz DOS computer system) was used for data acquisition and analysis. The X-radiation source was slightly modified to allow for computer control and monitoring of the unit by the computer. Two digital output lines were used for START and STOP of the X-ray tube current, and one digital input line was used to monitor the XRAY ON signal to assure that the unit was indeed on.

Figure 2:
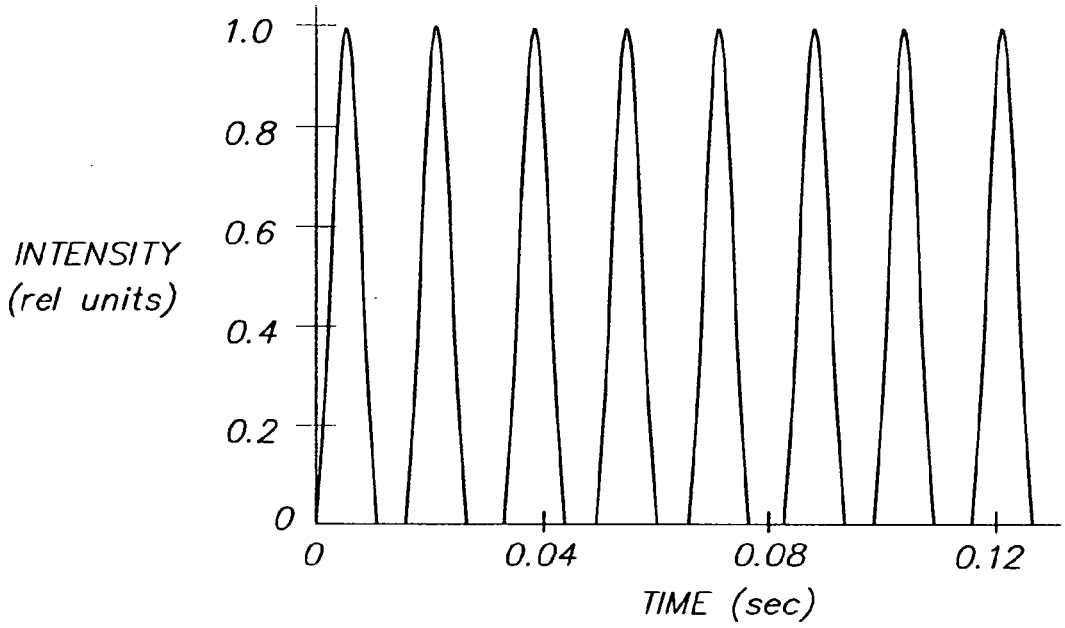
FIG. 2 is a graphical representation of the X-radiation waveform obtained from a typical test system used to determine SSM values.
Figure 3:
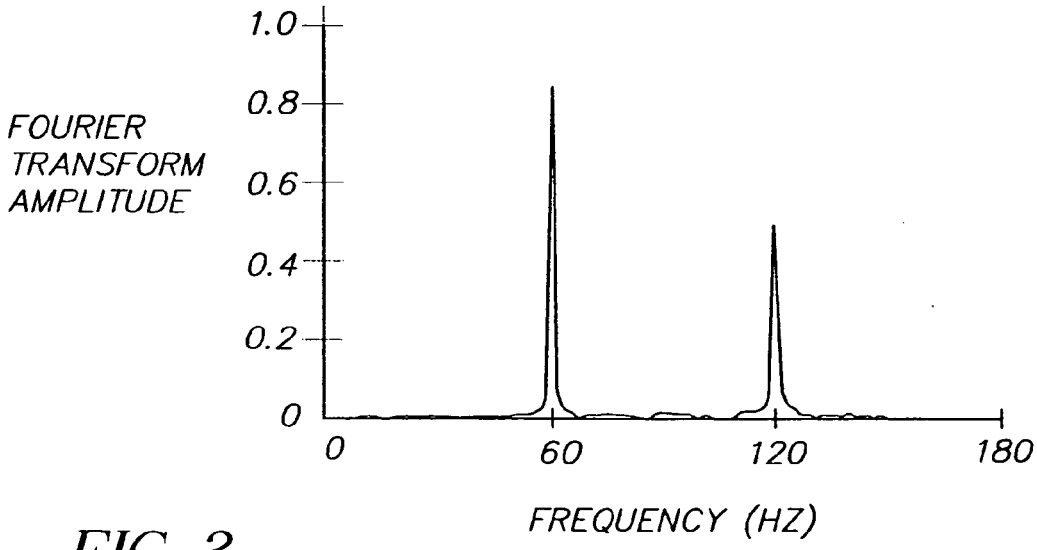
FIG. 3 is a graphical representation of a Fourier transform of data obtained from repetitions of X-radiation waveforms.

LSP was measured in the following manner. The optical slit/integrating sphere/PMT assembly was moved relative to X-ray slit 25. The X-radiation generation unit generated X-rays such that the intensity followed a 60 Hz single-wave rectified waveform in time as shown in FIG. 2. To take advantage of this, a single data point that represents the value of the LSP at a given spatial position was generated by acquiring an array of data at each spatial position using time intervals between points in this temporal array small enough such that the X-ray intensity waveform can be adequately represented by this array of data. Several repetitions of the waveform were captured in one array of data. A Fourier transform of this array of data yielded an array of data giving the amplitude of signal at various temporal frequencies that looked like that shown in FIG. 3. After the transform was done, the integral (sum) under the 60 and 120 Hz peaks was used as the value of the LSP at the current spatial position.

When the phosphor screen sample had been placed in the X-radiation generating unit, and the computer program for acquisition has been initiated, the program first set the proper high voltage to the PMT. This allows phosphor screens of any brightness to be tested. After the computer had turned on the X-radiation generating unit, but prior to beginning the actual LSP data acquisition, the computer performed a brief data acquisition near the peak region of the LSP so that it can find the actual peak. The computer then positions the translation stage at this peak signal position and adjusted the PMT high voltage to provide peak signal between ½ and full scale of the analog-to-digital converter range. The translation stage was then moved 500 positions away from the peak and data acquisition is begun.

There are 1000 spatial positions, each separated by 10 m$\mu$, at which the value of the LSP was determined. The peak of the LSP was approximated at data point 500. Given that the majority of the LSP data acquired represent baseline, for the first 400 values of the LSP and the last 400 values of the LSP, fewer actual data points were acquired, and the intermediate points (between the actual points) were determined by simple linear interpolation. For each actual data point in these "baseline" regions, the temporal data array was long enough to capture eight repetitions of the single wave rectified X-ray generator waveform. In an effort to minimize errors on the baseline from current bursts in the PMT, a running average value for the baseline was determined and the next data point must fall within some predetermined range of that running average or the acquisition is repeated. For LSP data values 401–600, a data point was acquired at each spatial position. To improve the signal-to-noise in this portion of the LSP, effectively 32 repetitions of the waveform were captured (the average of 4 repeats of the 8 waveform acquisition). At the completion of the acquisition, the PMT high voltage was reduced to zero, the X-radiation generating unit was turned off, and the stage was positioned approximately at data point 500 (the peak of the LSP).

Substantial smoothing of the baseline of the data array was done to aid in subsequent analysis. A mirror analysis was done to assure symmetry to the LSP. This mirror analysis consists of varying the midpoint for the LSP array by amounts less than a full data point spacing, re-sampling the array by interpolation, then calculating the difference between points at mirror positions relative to a given midpoint. The value of the midpoint that gives the minimum difference between left and right is the optimal midpoint. The LSP array was then forced to be symmetric by placing the average value of two mirror points in place of the actual data value for each point in a mirror set. The value of the LSP at the peak position was determined by fitting a parabola to the two points on either side of, the peak position.

After this mirror analysis was completed, the baseline was subtracted. The baseline value removed was determined by averaging values at the beginning and the end of the data array. To eliminate noise in the resulting SSM caused by noise in the baseline data, the baseline data were replaced with an extrapolation of the LSP by fitting an exponential function (least squares method) to the LSP data from 4% down to 1% of the peak value. Then, a Hanning window was applied to the data:

$$(x'_n = x_n[0.5(1-\cos(2\pi n/1000))]).$$

Finally, the Fourier transform of the LSP was computed. The equation used for this transformation is $$X_k = \frac{1}{N}\sum_{n=0}^{N-1} x_n e^{-2\pi i\left(\frac{nk}{N}\right)}$$

wherein $X_k$ represents the modulation at frequency k, and $x_n$ is the measured LSP at spatial positions n. By the properties of the discrete Fourier Transform, the combination of 1000 data points at a spacing of 10 m$\mu$ yielded an array of data after the Fourier Transform that are spaced every 0.1 cycles/mm. The modulation array was normalized to a value of 1.0 at zero spatial frequency. This modulation data gave a measure of the screen sharpness, i.e. the higher the modulation (closer to 1) at higher spatial frequencies, the sharper the image that the phosphor screen can produce. The value of the modulation at selected spatial frequencies is the "Screen Sharpness Measurement" (SSM).

Where two of the same screens ("symmetric screens") are used on opposing sides of the radiographic film in the imaging assemblies, the SSM value would be the same for each screen. Where two different screens ("asymmetric screens") are used on opposing sides of the radiographic film, the SSM value used in the practice of this invention is an average of the individual SSM values for the two screens.

Figure 4:
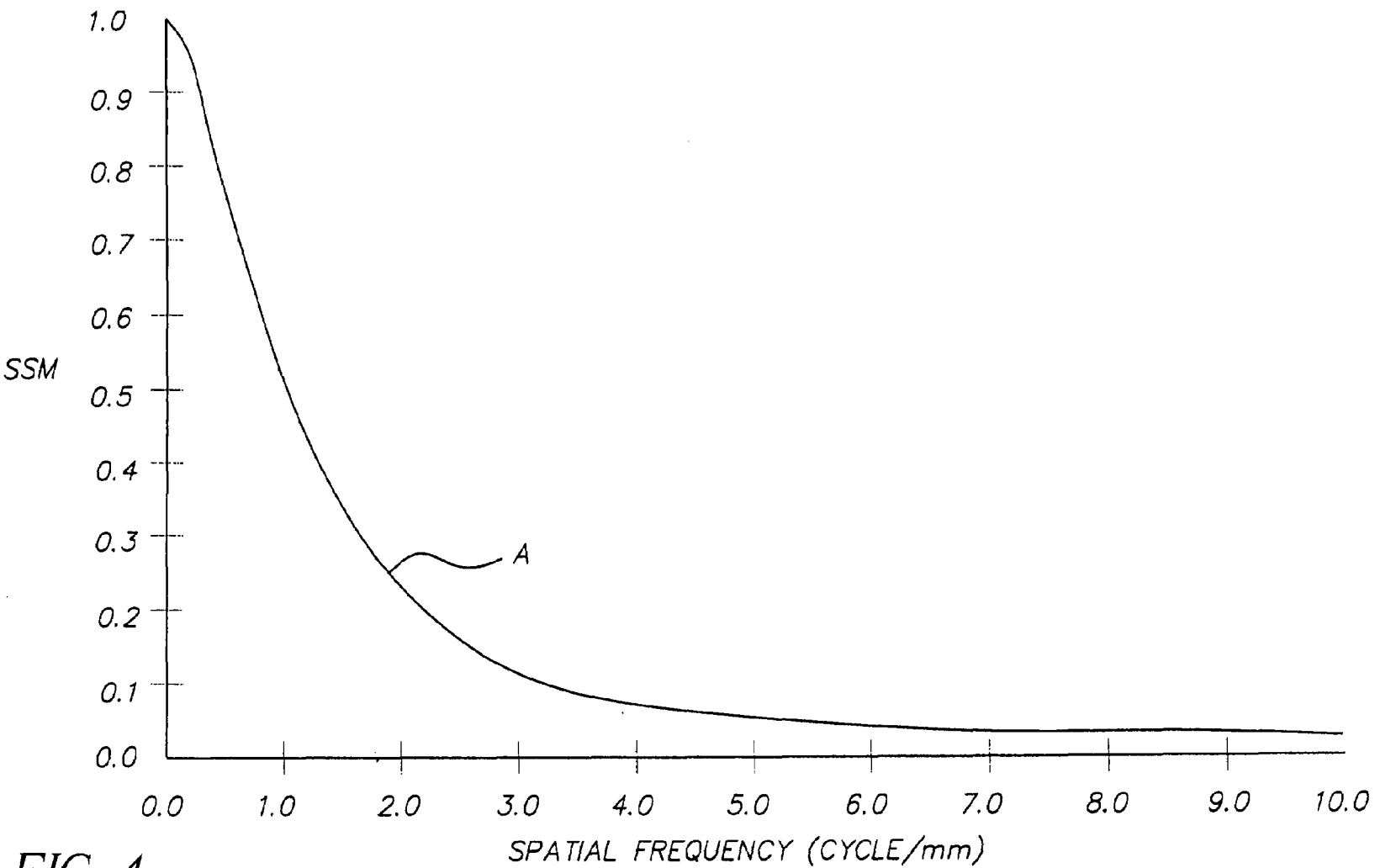
FIG. 4 is a graphical representation of SSM vs. spatial frequencies for the imaging assembly of the present invention described in Example 1 using Film C and Screen Y.

For example, the fluorescent intensifying screens used in the practice of this invention are capable of providing an SSM value greater than those represented by reference Curve A of FIG. 4 at any point along Curve A over the spatial frequency range of from 0 to 10 cycles/mm. TABLE 1 below lists selected SSM vs. spatial frequency data from which FIG. 4 was generated. Preferred screens used in the practice of this invention are those having SSM values that are at least 1.1 times those represented by reference Curve A of FIG. 4 over a range a spatial frequency range of from 1 to 10 cycles/mm.

TABLE I

| SSM | Spatial Frequency (cycles/mm) |
|---|---|
| 1.000 | 0 |
| 0.821 | 0.5 |
| 0.547 | 1.0 |
| 0.357 | 1.5 |
| 0.240 | 2.0 |
| 0.165 | 2.5 |
| 0.118 | 3.0 |
| 0.087 | 3.5 |
| 0.066 | 4.0 |
| 0.053 | 4.5 |
| 0.044 | 5.0 |
| 0.038 | 5.5 |
| 0.032 | 6.0 |
| 0.028 | 6.5 |
| 0.024 | 7.0 |
| 0.020 | 7.5 |
| 0.017 | 8.0 |
| 0.015 | 8.5 |
| 0.013 | 9.0 |
| 0.011 | 9.5 |
| 0.010 | 10.0 |

The term "duplitized" is used to define a radiographic film having one or more silver halide emulsion layers disposed on both the front- and backsides of the support. The radiographic silver halide films useful in the present invention are "duplitized."

The radiographic silver halide films useful in the present invention are "symmetric" films wherein the sensitometric responses and properties are essentially the same on both sides of the support. However, this does not necessarily mean that the silver halide emulsion layers on both sides of the support are compositionally the same. In preferred embodiments, the films have essentially the same imaging and non-imaging layers on both sides of the support to give essentially the same sensitometric response and properties.

In referring to grains and silver halide emulsions containing two or more halides, the halides are named in order of ascending molar concentrations.

The term "equivalent circular diameter" (ECD) is used to define the diameter of a circle having the same projected area as a silver halide grain. This can be measured using known techniques.

The term "aspect ratio" is used to define the ratio of grain ECD to grain thickness.

The term "coefficient of variation" (COV) is defined as 100 times the standard deviation (a) of grain ECD divided by the mean grain ECD.

The term "fluorescent intensifying screen" refers to a screen that absorbs X-radiation and emits light. A "prompt" emitting fluorescent intensifying screen will emit light immediately upon exposure to radiation while "storage" fluorescent screen can "store" the exposing X-radiation for emission at a later time when the screen is irradiated with other radiation (usually visible light).

The terms "front" (or frontside) and "back" (or backside) refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. The publication is also available from Emsworth Design Inc., 147 West 24th Street, New York, N.Y. 10011.

Radiographic Films

The radiographic silver halide films useful in this invention have a speed of at least 400 and preferably of at least 800, and include a support having disposed on both sides thereof, one or more photographic silver halide emulsion (hydrophilic colloid) layers and optionally one or more non-light sensitive hydrophilic colloid layer(s). Thus, the "first" silver halide emulsion layer is considered to be disposed on the frontside of the support and the "second" silver halide emulsion layer is considered to be disposed on the backside of the support. The first and second silver halide emulsion layers can be the same or different in chemical composition as long as the sensitometric properties are the same on both sides of the support.

In most preferred embodiments, the radiographic silver halide films have the same, single silver halide emulsion layer on each side of the support and a protective overcoat (described below) over all layers on each side of the support. Thus, in these most preferred embodiments, the first and second silver halide emulsion layers have essentially the same chemical composition (for example, components, types of grains, silver halide composition, hydrophilic colloid binder composition, $g/m^2$ coverage).

The support can take the form of any conventional radiographic support that is X-radiation and light transmissive. Useful supports for the films of this invention can be chosen from among those described in *Research Disclosure*, September 1996, Item 38957 (Section XV Supports) and *Research Disclosure*, Vol. 184, August 1979, Item 18431 (Section XII Film Supports). The support is preferably a transparent flexible support. In its simplest possible form the transparent support consists of a transparent flexible polymeric film chosen to allow direct adhesion of the hydrophilic silver halide emulsion layers or other hydrophilic layers. More commonly, the transparent support is itself hydrophobic and subbing layers are coated on the support to facilitate adhesion of the hydrophilic layers. Typically the support is either colorless or blue tinted (tinting dye being present in either or both the support or subbing layers). Polyethylene terephthalate and polyethylene naphthalate are the preferred transparent support materials.

In the more preferred embodiments, at least one non-light sensitive hydrophilic layer is included with the silver halide emulsion layer on each side of the support. This layer may be an interlayer or overcoat, or both types of non-light sensitive layers can be present.

The first and second silver halide emulsion layers comprise predominantly (more than 50%, and preferably at least 70%, of the total grain projected area) tabular silver halide grains. The grain composition can vary among the silver halide emulsion layers, but preferably, the grain composition is essentially the same in all of the silver halide emulsion layers. These tabular silver halide grains generally comprise at least 50, preferably at least 90, and more preferably at least 95, mol % bromide, based on total silver in the particular emulsion layer. Such emulsions include silver halide grains composed of, for example, silver iodobromide, silver chlorobromide, silver iodochlorobromide, and silver chloroiodobromide. The iodide grain content is generally up to 5 mol %, based on total silver in the emulsion layer. Preferably the iodide grain content is up to 3 mol %, and more preferably up to about 1 mol % (based on total silver in the emulsion layer). Mixtures of different tabular silver halide grains can be used in either of the silver halide emulsion layers.

Any silver halide emulsion layer can also include some non-tabular silver halide grains having any desirable non-tabular morphology or be comprised of a mixture of two or more of such morphologies. The composition and methods of making such silver halide grains are well known in the art.

The tabular silver halide grains used in the first and second silver halide emulsion layers generally and independently have as aspect ratio of 15 or more, preferably 25 or more and up to 45, and more preferably from about 38 to about 45. The aspect ratio can be the same or different in the first and second silver halide emulsion layers, but preferably, the aspect-ratio is essentially the same in both layers.

In general, the tabular grains in any of the silver halide emulsion layers independently have an average grain diameter (ECD) of at least 3.0 $\mu$m, and preferably of at least 3.5 $\mu$m. The average grain diameters can be the same or different in the various silver halide emulsion layers. At least 100 non-overlapping tabular grains are measured to obtain the "average" ECD.

In addition, the tabular grains in the first and second silver halide emulsion layers generally and independently have an average thickness of from about 0.06 to about 0.16 $\mu$m, preferably from about 0.08 to about 0.14 $\mu$m, and more preferably from about 0.09 to about 0.11 $\mu$m. The average thickness can be the same or different but preferably it is essentially the same for the first and second silver halide emulsion layers.

The procedures and equipment used to determine tabular grain size (and aspect ratio) are well known in the art. Tabular grain emulsions that have the desired composition and sizes are described in greater detail in the following patents, the disclosures of which are incorporated herein by reference in relation to the tabular grains:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

The first and second silver halide emulsion layers can have the same or different dry unprocessed thickness and coating weight, but preferably, the two silver halide emulsion layers have the same dry thickness and coating weight.

Unlike many other radiographic silver halide films known in the art, the radiographic silver halide films useful in this invention do not contain what are known as "crossover control agents". This means that such agents are not intentionally included in or incorporated into the films but it is understood that some other components of the films (for example, tabular silver halide grains) may inherently reduce crossover to some extent.

A variety of silver halide dopants can be used, individually and in combination, in one or more of the silver halide emulsion layers to improve contrast as well as other common sensitometric properties. A summary of conventional dopants is provided in *Research Disclosure*, Item 38957 [Section I Emulsion grains and their preparation, sub-section D, and grain modifying conditions and adjustments are in paragraphs (3), (4), and (5)].

A general summary of silver halide emulsions and their preparation is provided in *Research Disclosure*, Item 38957 (Section I Emulsion grains and their preparation). After precipitation and before chemical sensitization the emulsions can be washed by any convenient conventional technique using techniques disclosed by *Research Disclosure*, Item 38957 (Section III Emulsion washing).

Any of the emulsions can be chemically sensitized by any convenient conventional technique as illustrated by *Research Disclosure*, Item 38957 (Section IV Chemical Sensitization). Sulfur, selenium or gold sensitization (or any combination thereof) is specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

In addition, if desired, any of the silver halide emulsions can include one or more suitable spectral sensitizing dyes that include, for example, cyanine and merocyanine spectral sensitizing dyes. The useful amounts of such dyes are well known in the art but are generally within the range of from about 200 to about 1000 mg/mole of silver in the given emulsion layer. It is preferred that all of the tabular silver halide grains used in the present invention (in all silver halide emulsion layers) be "green-sensitized", that is spectrally sensitized to radiation of from about 470 to about 570 nm of the electromagnetic spectrum. Various spectral sensitizing dyes are known for achieving this property.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated in *Research Disclosure*, Item 38957 (Section VII Antifoggants and stabilizers) and Item 18431 (Section II Emulsion Stabilizers, Antifoggants and Antikinking Agents).

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or =S moiety. Such compounds are described in U.S. Pat. No. 5,800,976 (Dickerson et al.) that is incorporated herein by reference for the teaching of such sulfur-containing covering power enhancing compounds.

The silver halide emulsion layers and other hydrophilic layers on both sides of the support of the radiographic films generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957 (Section II Vehicles, vehicle extenders, vehicle-like addenda and vehicle related addenda). The emulsions themselves can contain peptizers of the type set out in Section II, paragraph A (Gelatin and hydrophilic colloid peptizers). The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes, polyacrylamides (including polymethacrylamides), and dextrans as described in U.S. Pat. No. 5,876,913 (Dickerson et al.), incorporated herein by reference.

Thin, high aspect ratio tabular grain silver halide emulsions useful in the present invention will typically be prepared by processes including nucleation and subsequent growth steps. During nucleation, silver and halide salt solutions are combined to precipitate a population of silver halide nuclei in a reaction vessel. Double jet (addition of silver and halide salt solutions simultaneously) and single jet (addition of one salt solution, such as a silver salt solution, to a vessel already containing an excess of the other salt) process are known. During the subsequent growth step, silver and halide salt solutions, and/or preformed fine silver halide grains, are added to the nuclei in the reaction vessel, and the added silver and halide combines with the existing population of grain nuclei to form larger grains. Control of conditions for formation of high aspect ratio tabular grain silver bromide and iodobromide emulsions is known, for example, based upon U.S. Pat. No. 4,434,226 (Wilgus et al.), U.S. Pat. No. 4,433,048 (Solberg et al.), and U.S. Pat. No. 4,439,520 (Kofron et al.). It is recognized, for example, that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, U.S. Pat. No. 4,434,226 (Wilgus et al.), for example, teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. U.S. Pat. No. 4,439,520 (Kofron et al.) extends these teachings to the precipitation of high aspect ratio tabular grain silver bromide emulsions. pBr is defined as the negative log of the solution bromide ion concentration. U.S. Pat. No. 4,414,310 (Daubendiek et al.) describes a process for the preparation of high aspect ratio silver bromoiodide emulsions under pBr conditions not exceeding the value of 1.64 during grain nucleation. U.S. Pat. No. 4,713,320 (Maskasky), in the preparation of high aspect ratio silver halide emulsions, teaches that the useful pBr range during nucleation can be extended to a value of 2.4 when the precipitation of the tabular silver bromide or bromoiodide grains occurs in the presence of gelatino-peptizer containing less than 30 micromoles of methionine (for example, oxidized gelatin) per gram. The use of such oxidized gel also enables the preparation of thinner and/or larger diameter grains, and/or more uniform grain populations containing fewer non-tabular grains.

The use of oxidized gelatin as peptizer during nucleation, such as taught by U.S. Pat. No. 4,713,320 (noted above), is particularly preferred for making thin, high aspect ratio tabular grain emulsions for use in the present invention, employing either double or single jet nucleation processes. As gelatin employed as peptizer during nucleation typically will comprise only a fraction of the total gelatin employed in an emulsion, the percentage of oxidized gelatin in the resulting emulsion may be relatively small, that is, at least 0.05% (based on total dry weight of hydrophilic polymer vehicle mixture). However, more gelatin (including oxidized gelatin) is usually added to the formulation at later stages (for example, growth stage) so that the total oxidized gelatin can be greater, and for practical purposes as high as 18% (based on total dry weight of hydrophilic polymer vehicle mixture in the silver halide emulsion layer).

In preferred embodiments, the coated first and second tabular grain silver halide emulsion layers comprise tabular silver halide grains dispersed in a hydrophilic polymeric vehicle mixture comprising at least 0.05%, preferably at least 1%, and more preferably at least 5%, of oxidized gelatin based on the total dry weight of hydrophilic polymer vehicle mixture in that coated emulsion layer. The upper limit for the oxidized gelatin is not critical but for practical purposes, it is 18%, and preferably up to 15%, based on the total dry weight of the hydrophilic polymer vehicle mixture. Preferably, from about 5 to about 15% (by dry weight) of the hydrophilic polymer vehicle mixture is oxidized gelatin.

The oxidized gelatin may be in the form of deionized oxidized gelatin but non-deionized oxidized gelatin may be preferred because of the presence of ions, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 $\mu$mol of methionine, and more preferably from 0 to 1 $\mu$mol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the radiographic films are generally fully hardened using one or more conventional hardeners. Thus, the amount of hardener on each side of the support is generally at least 1% and preferably at least 1.5%, based on the total dry weight of the polymer vehicles on each side of the support.

The levels of silver and polymer vehicle in the radiographic silver halide film can vary in the various silver halide emulsion layers. In general, the total amount of silver on each side of the support is at least 10 and no more than 25 mg/dm$^2$ (preferably from about 18 to about 24 mg/dm$^2$). In addition, the total coverage of polymer vehicle on each side of the support is generally at least 20 and no more than 40 mg/dm$^2$ (preferably from about 30 to about 40 mg/dm$^2$). The amounts of silver and polymer vehicle on the two sides of the support in the radiographic silver halide film can be the same or different as long as the sensitometric properties on both sides are the same. These amounts refer to dry weights.

The radiographic silver halide films generally include a surface protective overcoat disposed on each side of the support that typically provides for physical protection of the various layers underneath. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are described in *Research Disclosure*, Item 38957 (Section IX Coating physical property modifying addenda, A. Coating aids, B. Plasticizers and lubricants, C. Antistats, and D. Matting agents). Interlayers that are typically thin hydrophilic colloid layers can be used to provide a separation between the silver halide emulsion layers and the surface overcoats or between the silver halide emulsion layers. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers.

The various coated layers of radiographic silver halide films can also contain tinting dyes to modify the image tone to transmitted or reflected light. These dyes are not decolorized during processing and may be homogeneously or heterogeneously dispersed in the various layers. Preferably, such non-bleachable tinting dyes are in one or more silver halide emulsion layers.

Imaging Assemblies

The radiographic imaging assembly is composed of one radiographic silver halide film as described herein and two fluorescent intensifying screens to provide a cumulative system speed of at least 900 (preferably at least 1000) for the entire "system". The film and screens are generally arranged in a suitable "cassette" designed for this purpose. One screen is on the "frontside" (first exposed to X-radiation) and the other screen is on the "backside" of the film. Fluorescent intensifying screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens and methods of making them are provided in *Research Disclosure*, Item 18431 (Section IX X-Ray Screens/Phosphors) and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles dispersed in a suitable binder, and may also include a light scattering material, such as titania.

Any conventional or useful phosphor can be used, singly or in mixtures, in the intensifying screens. For example, useful phosphors are described in numerous references relating to fluorescent intensifying screens, including but not limited to, *Research Disclosure*, Vol. 184, August 1979, Item 18431 (Section IX X-ray Screens/Phosphors) and U.S. Pat. No. 2,303,942 (Wynd et al.), U.S. Pat. No. 3,778,615 (Luckey), U.S. Pat. No. 4,032,471 (Luckey), U.S. Pat. No.

4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 4,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), and U.S. Pat. No. 5,871,892 (Dickerson et al.), and EP 0 491,116A1 (Benzo et al.), the disclosures of all of which are incorporated herein by reference with respect to the phosphors.

The inorganic phosphor can be calcium tungstate, activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Alternatively, the inorganic phosphor is a rare earth oxychalcogenide and oxyhalide phosphors and represented by the following formula (1):

$$M'_{(w-n)}M''_nO_wX' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Th), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides or oxysulfides (such as $Gd_2O_2S$:Tb).

Other suitable phosphors are described in U.S. Pat. No. 4,835,397 (Arakawa et al.) and U.S. Pat. No. 5,381,015 (Dooms), both incorporated herein by reference, and include for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another class of useful phosphors includes rare earth hosts such as rare earth activated mixed alkaline earth metal sulfates such as europium-activated barium strontium sulfate.

Particularly useful phosphors are those containing doped or undoped tantalum such as $YTaO_4$, $YTaO_4$:Nb, Y(Sr)$TaO_4$, and Y(Sr)$TaO_4$:Nb. These phosphors are described in U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), all incorporated herein by reference.

Other useful phosphors are alkaline earth metal phosphors that can be the products of firing starting materials comprising optional oxide or a combination of species as characterized by the following formula (2):

$$MFX_{1-z}I_zuM^aX^a{:}yA{:}eQ{:}tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Th), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is form 0 to 1, and "t" is from 0 to 0.01. These definitions apply wherever they are found in this application unless specifically stated to the contrary. It is also contemplated that "M", "X", "A", and "D" represent multiple elements in the groups identified above.

The phosphor can be dispersed in a suitable binder(s) in a phosphor layer. A particularly useful binder is a polyurethane binder such as that commercially available under the trademark Permuthane.

The fluorescent intensifying screens useful in this invention exhibit a photographic speed of at least 400 and preferably of at least 600. One preferred phosphor is a terbium activated gadolinium oxysulfide. A skilled worker in the art would be able to choose the appropriate inorganic phosphor, its particle size, and coverage in the phosphor layer to provide the desired screen speed. However, the preferred coverage of phosphor in the dried layer can vary from about 4 to about 15 g/dm$^2$. The phosphor to binder weight ratio is from about 20:1 to about 22:1.

Support materials for fluorescent intensifying screens include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate, metal sheets such as aluminum foil and aluminum alloy foil, ordinary papers, baryta paper, resin-coated papers, pigmented papers containing titanium dioxide or the like, and papers sized with polyvinyl alcohol or the like. A flexible plastic film is preferably used as the support material.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity screen. It is highly preferred that the support absorbs substantially all of the radiation emitted by the phosphor. Examples of preferred supports include polyethylene terephthalate, blue colored or black colored (for example, LUMIRROR C, type X30 supplied by Toray Industries, Tokyo, Japan). These supports may have a thickness that may differ depending o the material of the support, and may generally be between 60 and 1000 μm, more preferably between 80 and 500 μm from the standpoint of handling.

A representative fluorescent intensifying screen useful in the present invention is described as Screen Y in Example 1 below. This screen can be prepared using components and procedures known by one skilled in the art.

In more preferred embodiments of this invention, flexible support materials for the screens include a specific reflective substrate that is a single- or multi-layer reflective sheet. At least one of the layers of this sheet is a reflective substrate that comprises a continuous polymer (particularly a polyester) first phase and a second phase dispersed within the continuous polymer first phase. This second phase comprises microvoids containing suitable reflective inorganic particles (especially barium sulfate particles).

Such a support is capable of reflecting at least 90% (preferably at least 94%) of incident radiation having a wavelength of from about 300 to about 700 nm. This property is achieved by the judicious selection of the polymer first phase, microvoids and proportion thereof, amount of inorganic particles such as barium sulfate particles, and the use of multiple layers having microvoids and/or particles.

The continuous polymer first phase of the reflective substrate provides a matrix for the other components of the reflective substrate and is transparent to longer wavelength electromagnetic radiation. This polymer phase can comprise a film or sheet of one or more thermoplastic polyesters, which film has been biaxially stretched (that is, stretched in both the longitudinal and transverse directions) to create the microvoids therein around the inorganic particles. Any suitable polyester can be used as long as it can be cast, spun, molded, or otherwise formed into a film or sheet, and can be biaxially oriented as noted above. Generally, the polyesters have a glass transition temperature of from about 50 to about 150° C. (preferably from about 60 to about 100° C.) as determined using a differential scanning calorimeter (DSC).

Suitable polyesters that can be used include, but are not limited to, poly(1,4-cyclohexylene dimethylene terephthalate), poly(ethylene terephthalate), poly(ethylene naphthalate), and poly(1,3-cyclohexylene dimethylene terephthalate). Poly(1,4-cyclohexylene dimethylene terephthalate) is most preferred.

The ratio of the reflective index of the continuous polymer first phase to the second phase is from about 1.4:1 to about 1.6:1.

As noted above, it is preferred that barium sulfate particles are incorporated into the continuous polyester phase as described below. These particles generally have an average particle size of from about 0.6 to about 2 μm (preferably from about 0.7 to about 1.0 μm). In addition, these particles comprise from about 35 to about 65 weight % (preferably from about 55 to about 60 weight %) of the total dry reflective substrate weight, and from about 15 to about 25% of the total reflective substrate volume.

The barium sulfate particles can be incorporated into the continuous polyester phase by various means. For example, they can be incorporated during polymerization of the dicarboxylic acid(s) and polyol(s) used to make the continuous polyester first phase. Alternatively and preferably, they are incorporated by mixing them into pellets of the polyester and extruding the mixture to produce a melt stream that is cooled into the desired sheet containing barium sulfate particles dispersed therein.

These particles are at least partially bordered by voids because they are embedded in the microvoids distributed throughout the continuous polymer first phase. Thus, the microvoids containing the particles comprise a second phase dispersed within the continuous polymer first phase. The microvoids generally occupy from about 35 to about 60% (by volume) of the dry reflective substrate.

The microvoids can be of any particular shape, that is circular, elliptical, convex, or any other shape reflecting the film orientation process and the shape and size of the barium sulfate particles. The size and ultimate physical properties of the microvoids depend upon the degree and balance of the orientation, temperature and rate of stretching, crystallization characteristics of the polymer, the size and distribution of the particles, and other considerations that would be apparent to one skilled in the art. Generally, the microvoids are formed when the extruded sheet containing particles is biaxially stretched using conventional orientation techniques.

Thus, in general, the reflective substrates used in the practice of this invention are prepared by:

(a) blending the inorganic particles (such as barium sulfate particles) into a desired polymer (such as a polyester) as the continuous phase, (b) forming a sheet of the polymer containing the particles, such as by extrusion, and (c) stretching the sheet in one or transverse directions to form microvoids around the particles.

The present invention does not require but permits the use or addition of various organic and inorganic materials such as pigments, anti-block agents, antistatic agents, plasticizers, dyes, stabilizers, nucleating agents, and other addenda known in the art to the reflective substrate. These materials may be incorporated into the polymer phase or they may exist as separate dispersed phases and can be incorporated into the polymer using known techniques.

The reflective substrate can have a thickness (dry) of from about 100 to about 400 μm (preferably from about 150 to about 225 μm). If there are multiple reflective substrates in the support, their thickness can be the same or different.

As noted above, the reflective substrate can be the sole layer of the support for the phosphor screen, but in some preferred embodiments, additional layers are formed or laminated with one or more reflective substrate to form a multi-layer or multi-strata support. In some embodiments, the support further comprises an additional layer such as a stretch microvoided polyester layer that has similar composition as the reflective substrate except that barium sulfate particles are omitted. This additional polyester layer is arranged adjacent the reflective substrate, but opposite the phosphor layer. In other words, the reflective layer is closer to the phosphor layer than the microvoided polyester layer.

The microvoided polymer layers can comprise microvoids in an amount of from about 35 to about 60% (by total layer volume). The additional layers (with or without microvoids) can have a dry thickness of from about 30 to about 120 μm (preferably from about 50 to about 70 μm). The polymer(s) in the additional layer can be same or different as those in the reflective substrate.

These additional microvoided polymer layers can also include organic or inorganic particles in the microvoids as long as those particles are not same particles as in the primary reflective layer. Useful particles includes polymeric beads (such as cellulose acetate particles), crosslinked polymeric microbeads, immiscible polymer particles (such as polypropylene particles), and other particulate materials known in the art that will not interfere with the desired reflectivity of the support required for the present invention.

A representative fluorescent intensifying screen useful in the present invention is described as Screen V in Example 2 below.

Imaging and Processing

Exposure and processing of the radiographic silver halide films can be undertaken in any convenient conventional manner. The exposure and processing techniques of U.S. Pat. Nos. 5,021,327 and 5,576,156 (both noted above) are typical for processing radiographic films. Exposing X-radiation is generally directed through a patient and then through a fluorescent intensifying screen arranged against the frontside of the film before it passes through the radiographic silver halide film, and the second fluorescent intensifying screen.

Processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multipart formulations, and in concentrated form or as more diluted working strength solutions.

It is particularly desirable that the radiographic silver halide films of this invention be processed generally within 90 seconds ("dry-to-dry") and preferably for at least 20 seconds and up to 60 seconds ("dry-to-dry"), including the developing, fixing, any washing (or rinsing) steps, and drying. Such processing can be carried out in any suitable processing equipment including but not limited to, a Kodak X-OMAT® RA 480 processor that can utilize Kodak Rapid Access processing chemistry. Other "rapid access processors" are described for example in U.S. Pat. No. 3,545,971. (Barnes et al.) and EP 0 248,390A1 (Akio et al.). Preferably, the black-and-white developing compositions used during processing are free of any photographic film hardeners, such as glutaraldehyde.

Radiographic kits can include an imaging assembly, additional fluorescent intensifying screens and/or metal screens, additional radiographic silver halide films, and/or one or more suitable processing compositions (for example black-and-white developing and fixing compositions).

The following examples are presented for illustration and the invention is not to be interpreted as limited thereby.

EXAMPLE 1

Radiographic Film A:

Radiographic Film A was a duplitized film having the two different silver halide emulsion layers on each side of a blue-tinted 170 μm transparent poly(ethylene terephthalate) film support and an interlayer and overcoat layer over each emulsion layer. The emulsions of Film A were not prepared using oxidized gelatin.

Radiographic Film A had the following layer arrangement:

Overcoat
Interlayer
Emulsion Layer
Support
Emulsion Layer
Interlayer
Overcoat

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Tabular grains [AgBr 2.9 μm ave. dia. × 0.10 μm thickness] | 16.1 Ag |
| Gelatin vehicle | 26.3 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2% based on total gelatin in all layers on each side |

Radiographic Film B:

Radiographic Film B was like Radiographic Film A except that the tabular silver halide grains in the emulsion layers had an average size of 2.9×0.12 μm and were coated at a coverage of 18.3 mg/dm$^2$.

Radiographic Film C:

Radiographic Film C was a duplitized, symmetric radiographic film with the same silver halide emulsion layer on each side of the support. The two emulsion layers contained tabular silver halide grains that were prepared and dispersed in oxidized gelatin that had been added at multiple times before and/or during the nucleation and early growth of the silver bromide tabular grains dispersed therein. The tabular grains of each silver halide emulsion layer had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 nm was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

Radiographic Film C had the following layer arrangement and formulations on the film support:

Overcoat
Interlayer
Emulsion Layer
Support
Emulsion Layer
Interlayer
Overcoat

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Tabular grains [AgBr 4.0 $\mu$m ave. dia. × 0.10 $\mu$m thickness] | 19.4 Ag |
| Oxidized gelatin vehicle | 3.3 |
| Non-oxidized gelatin vehicle | 23.0 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2.0 % based on total gelatin on each side |

The cassettes used for imaging contained a pair of the following screens on opposing sides of the noted radiographic films:

Fluorescent intensifying screen "X" was prepared using known procedures and components to have a terbium activated gadolinium oxysulfide phosphor (median particle size of 7.8 to 8 $\mu$m) dispersed in a Permuthane™ polyurethane binder on a white-pigmented poly(ethylene terephthalate) film support. The total phosphor coverage was 4.83 g/dm$^2$ and the phosphor to binder weight ratio was 19:1. The screen speed was 440.

Fluorescent intensifying screens "Y" were prepared using known procedures and components and included two different ("asymmetric") screens, one for the frontside of the film and the other for the backside. Each screen comprised a terbium activated gadolinium oxysulfide phosphor layer on a white-pigmented poly(ethylene terephthalate) film support. The phosphor (median particle size of 7.8 to 8 $\mu$m) was dispersed in a Permuthane™ polyurethane binder. The total phosphor coverage in the screen used on the frontside ("exposed side") was 4.83 g/dm$^2$ and the total phosphor coverage on the screen used on the backside was 13.5 g/dm$^2$. The phosphor to binder weight ratio in each screen was 19:1. The screen speed was 600.

Samples of the films in the imaging assemblies were exposed using an inverse square X-ray sensitometer (device that makes exceedingly reproducible X-ray exposures). A lead screw moved the detector between exposures. By use of the inverse square law, distances were selected that produced exposures that differed by 0.100 logE. The length of the exposures was constant. This instrument provided sensitometry that gives the response of the detector to an imagewise exposure where all of the image is exposed for the same length of time, but the intensity is changed due to the anatomy transmitting more or less of the X-radiation flux.

The exposed film samples were processed using a commercially available KODAK RP X-OMAT® Film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

Fixing was carried out using KODAK RP X-OMAT® LO Fixer and Replenisher fixing composition (Eastman Kodak Company). The film samples were processed in each instance for less than 90 seconds ("dry-to-dry").

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic density vs. logE curve was plotted for each radiographic film that was exposed and processed as noted above. System speed was measured as noted above. Contrast (gamma) is the slope (derivative) of the density vs. logE sensitometric curve. SSM data for the screens were determined as described above. Only the SSM values at 2 cycles/mm are reported in TABLE II but FIG. 4 shows the SSM data over the entire range of spatial frequencies for Screen Y (average SSM values for the two asymmetric screens) in an imaging assembly of the present invention.

The following TABLE II shows that increased system speed can be achieved by using either larger tabular silver halide grains (Film B) or "faster" screens (Screen Y). However, the use of larger tabular silver halide grains result in higher fog ($D_{min}$) and the use of a "faster" screen provides a lower SSM value. The present invention provides extremely high system speed (Film C with Screen X or Y) without increased fog. The images obtained using the present invention had excellent contrast in comparison to the imaging assembly comprised of Film A and Screen Y.

TABLE II

| Film | Tabular grain size (μm) | Screen | Contrast | Fog ($D_{min}$) | System Speed | Film Speed | SSM @ 2 cycles/mm |
|---|---|---|---|---|---|---|---|
| A (Control) | 2.9 × 0.10 | X | 2.9 | 0.27 | 400 | 400 | 0.49 |
| A (Control) | 2.9 × 0.10 | Y | 2.9 | 0.27 | 559 | 400 | 0.24 |
| B (Control) | 2.9 × 0.12 | X | 2.9 | 0.3 | 620 | 600 | 0.49 |
| B (Control) | 2.9 × 0.12 | Y | 2.9 | 0.3 | 865 | 600 | 0.24 |
| C (Invention) | 4.0 × 0.10 | X | 3.2 | 0.25 | 1007 | 1000 | 0.49 |
| C (Invention) | 4.0 × 0.10 | Y | 3.2 | 0.25 | 1406 | 1000 | 0.24 |

EXAMPLE 2

Cassettes used for imaging contained a pair of screens X, Y, or V, on opposing sides of the noted Radiographic Films A, B, or C described in Example 1.

Fluorescent intensifying screen "V" was a fluorescent intensifying screen that comprised a terbium activated gadolinium oxysulfide phosphor (median particle size of 7.8 to 8 μm) dispersed in a Permuthane™ polyurethane binder in a single phosphor layer on a microvoided poly(ethylene terephthalate) support. The total phosphor coverage was 9.2 g/dm$^2$ and the phosphor to binder weight ratio was 27:1. The screen speed was 600.

The microvoided support used in Screen V was prepared as a 3-layer film (with designated layers 1, 2 and 3) comprising voided polyester matrix layers. Materials used in the preparation of layers 1 and 3 of the film were a compounded blend consisting of 60% by weight of barium sulfate ($BaSO_4$) particles approximately 0.7 μm in diameter (Blanc Fixe XR-HN available from Sachtleben Corp.) and 40% by weight PETG 6763 resin (IV=0.73 dl/g) (an amorphous polyester resin available from Eastman Chemical Company). The $BaSO_4$ inorganic particles were compounded with the PETG polyester by mixing in a counter-rotating twin-screw extruder attached to a strand die. Strands of extrudate were transported through a water bath, solidified, and fed through a pelletizer, thereby forming pellets of the resin mixture. The pellets were then dried in a desiccant dryer at 65° C. for 12 hours.

As the material for layer 2, poly(ethylene terephthalate) (#7352 from Eastman Chemicals Company) was dry blended with polypropylene ("PP", Huntsman P4G2Z-073AX) at 25% weight and dried in a desiccant dryer at 65° C. for 12 hours.

Cast sheets of the noted materials were co-extruded to produce a combined support having the following layer arrangement: layer 1/layer 2/layer 3, using a 2.5 inch (6.35 cm) extruder to extrude layer 2, and a 1 inch (2.54 cm) extruder to extrude layers 1 and 3. The 275° C. melt streams were fed into a 7 inch (17.8 cm) multi-manifold die also heated at 275° C. As the extruded sheet emerged from the die, it was cast onto a quenching roll set at 55° C. The PP in layer 2 dispersed into globules between 10 and 30 μm in size during extrusion. The final dimensions of the continuous cast multilayer sheet were 18 cm wide and 860 μm thick. Layers 1 and 3 were each 215 μm thick while layer 2 was 430 μm thick. The cast multilayer sheet was then stretched at 110° C. first 3.0 times in the X-direction and then 3.4 times in the Y-direction. The stretched sheet was then heat set at 150° C. and its final thickness was 175 μm.

A dispersion of green-emitting, terbium-doped gadolinium oxysulfide phosphor with a mean particle size of 6.8 μm was prepared from 100 g of the phosphor in a solution prepared from 117 g of polyurethane binder (trademark Permuthane U-6366) at 10% (by weight) in a 93:7 volume ratio of dichloromethane and methanol. The resulting dispersion was coated to provide a phosphor coverage of 605 g/m$^2$ on the 3-layer reflective support noted above to produce Screen V.

Samples of the films in the three imaging assemblies were exposed and processed as described in Example 1. Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic density vs. logE curve was plotted for each radiographic film that was exposed and processed as noted above. System speed was measured as noted above. Contrast (gamma) is the slope (derivative) of the density vs. logE sensitometric curve. SSM data for the screens were determined as described above. Only the SSM values at 2 cycles/mm are reported in TABLE III but FIG. 5 shows the SSM data over the entire range of spatial frequencies for Screen V in an imaging assembly of the present invention.

Figure 5:
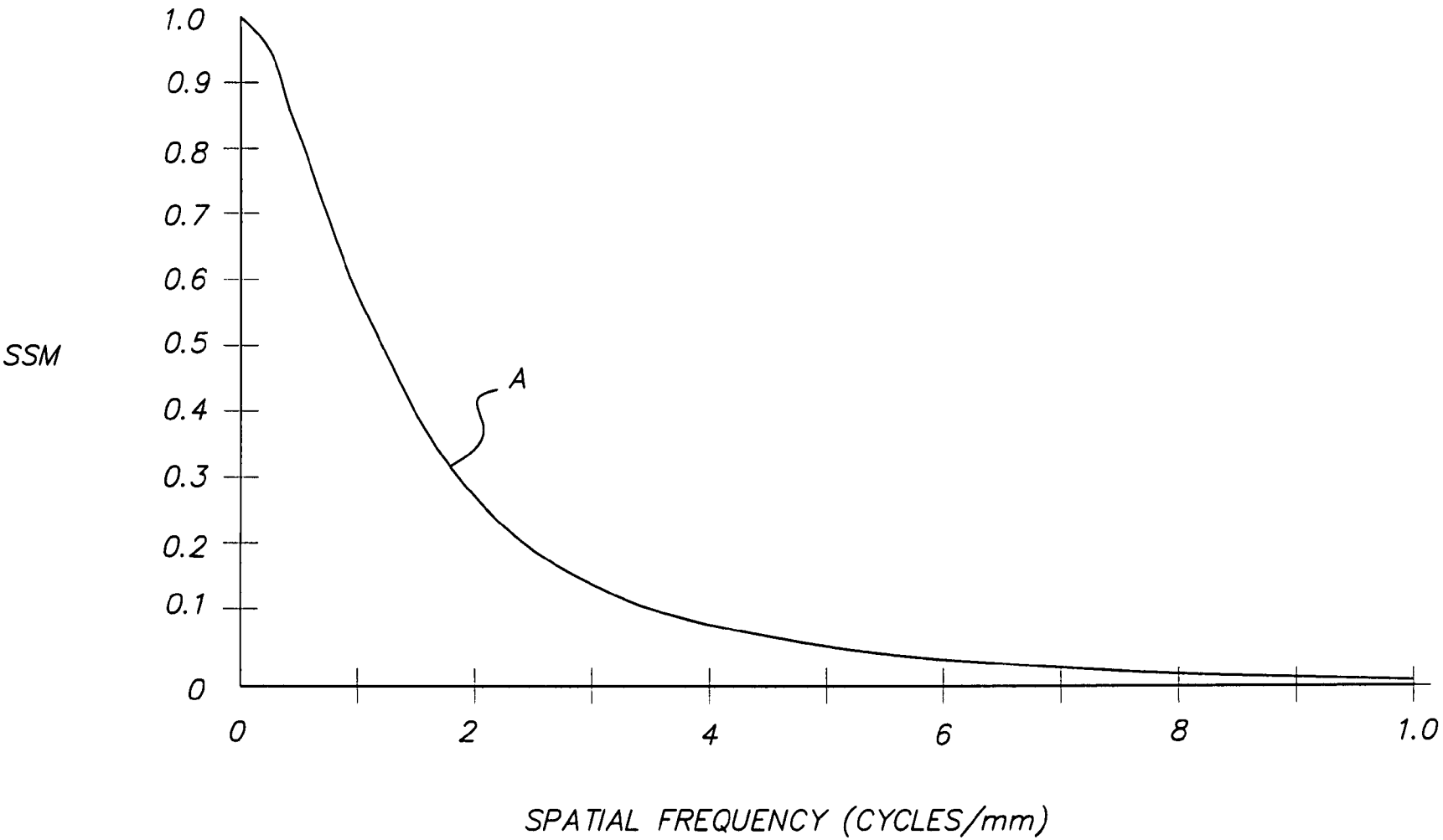
FIG. 5 is a graphical representation of SSM vs. spatial frequencies for the imaging assembly of the present invention described in Example 2 using Film C and Screen V.

FIG. 5 was generated from the following values shown in TABLE III:

TABLE III

| SSM | Spatial Frequency (cycles/mm) |
|---|---|
| 1.000 | 0 |
| 0.830 | 0.5 |
| 0.592 | 1.0 |
| 0.410 | 1.5 |
| 0.283 | 2.0 |
| 0.201 | 2.5 |
| 0.146 | 3.0 |
| 0.108 | 3.5 |
| 0.083 | 4.0 |
| 0.065 | 4.5 |
| 0.051 | 5.0 |
| 0.042 | 5.5 |
| 0.034 | 6.0 |
| 0.028 | 6.5 |
| 0.023 | 7.0 |
| 0.018 | 7.5 |
| 0.025 | 8.0 |
| 0.012 | 8.5 |
| 0.010 | 9.0 |
| 0.009 | 9.5 |
| 0.008 | 10.0 |

The following TABLE IV shows that using either Film A or Film B achieved increased system speed but fog was also increased. In addition, as the speed is increased using a given film, the SSM value decreased. However, the combination of Film C and Screen V had a high system speed and provided images with desired sharpness and an acceptable level of fog.

TABLE IV

| Film | Tabular grain size (μm) | Screen | Contrast | Fog ($D_{min}$) | System Speed | Film Speed | SSM @ 2 cycles/mm |
|---|---|---|---|---|---|---|---|
| A (Control) | 2.9 × 0.10 | X | 2.9 | 0.27 | 400 | 400 | 0.49 |
| A (Control) | 2.9 × 0.10 | Y | 2.9 | 0.27 | 559 | 400 | 0.24 |
| B (Control) | 2.9 × 0.12 | X | 2.9 | 0.3 | 620 | 600 | 0.49 |
| B (Control) | 2.9 × 0.12 | Y | 2.9 | 0.3 | 865 | 600 | 0.24 |
| C (Invention) | 4.0 × 0.10 | X | 3.2 | 0.25 | 1007 | 1000 | 0.49 |
| C (Invention) | 4.0 × 0.10 | Y | 3.2 | 0.25 | 1406 | 1000 | 0.24 |
| C (Invention) | 4.0 × 0.10 | V | 3.2 | 0.25 | 1406 | 1000 | 0.28 |

EXAMPLE 3

Radiographic Film C described above in Example 1 can also be combined with pairs of the fluorescent intensifying screens shown in TABLE V. Those imaging assemblies having system speeds of at least 700 are within the scope of the present invention.

| Film | Screen | Screen Speed | System Speed | SSM @ 2 cycles/mm |
|---|---|---|---|---|
| C | KODAK Lanex ® Fine | 100 | 300 | 0.83 |
| C | KODAK InSight ® Skeletal Medium | 180 | 500 | 0.79 |
| C (Invention) | KODAK Lanex ® Medium | 280 | 700 | 0.49 |

The invention has been described in detail with particular reference to preferred embodiments thereof, but it will be understood that variations and modifications can be effected within the spirit and scope of the invention.

PARTS LIST

10 slit-shaped X-ray
15 phosphor screen sample
20 optical slit
25 X-ray slit or mask
30 photomultiplier tube (PMT)
35 integrating sphere
45 profile or spread

What is claimed is:

1. A radiographic imaging assembly that has a system speed of at least 700 and comprises:

A) a symmetric radiographic silver halide film having a film speed of at least 400 and comprising a support that has first and second major surfaces, said radiographic silver halide film having disposed on said first major support surface, one or more hydrophilic colloid layers including a first silver halide emulsion layer, and having on said second major support surface, one or more hydrophilic colloid layers including a second silver halide emulsion layer, and B) a fluorescent intensifying screen arranged on each side of said radiographic silver halide film, the pair of screens having a screen speed of at least 400 and said screens having an average screen sharpness measurement (SSM) value greater than reference Curve A of FIG. 4, and each screen comprising an inorganic phosphor capable of absorbing X-rays and emitting electromagnetic radiation having a wavelength greater than 300 nm, said inorganic phosphor being coated in admixture with a polymeric binder in a phosphor layer on a support.

2. The imaging assembly of claim 1 wherein each of said first and second silver halide emulsion layers comprise tabular silver halide grains that have the same or different composition and independently an aspect ratio of at least 15, an average grain diameter of at least 3.0 μm, and comprise at least 50 mol % bromide and up to 5 mol % iodide, both based on total silver in said grains.

3. The imaging assembly of claim 2 wherein said tabular silver halide grains in said first and second silver halide emulsion layers are composed of at least 90 mol % bromide, up to 1 mol % iodide, both based on total silver in the emulsion layer, and independently have an aspect ratio of from about 25 to about 45, an average grain diameter of at least 3.5 μm, and independently an average thickness of from about 0.06 to about 0.16 μm.

4. The imaging assembly of claim 1 wherein said tabular silver halide grains in said first and second silver halide emulsion layers are dispersed in a hydrophilic polymeric vehicle mixture comprising at least 0.05% of oxidized gelatin, based on the total dry weight of said hydrophilic polymeric vehicle mixture.

5. The imaging assembly of claim 4 wherein said tabular silver halide grains in said first and second silver halide emulsion layers are dispersed in from about 1 to about 15% deionized oxidized gelatin, based on the total dry weight of said hydrophilic polymer vehicle mixture.

6. The imaging assembly of claim 1 wherein the amount polymer vehicle on each side of said support is from about 20 to about 40 mg/dm$^2$, and the level of silver on each side of said support is from about 10 to about 25 mg/dm$^2$.

7. The imaging assembly of claim 1 wherein said radiographic silver halide film contains no incorporated crossover control agent.

8. The imaging assembly of claim 1 wherein said inorganic phosphor is a terbium activated gadolinium oxysulfide.

9. The imaging assembly of claim 1 wherein said inorganic phosphor is:

a) a rare earth oxychalcogenide and oxyhalide phosphor that is represented by the following formula (1):

$$M'_{(w-n)}M''_{n}O_{w}X' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Th), thulium (Tm), or ytterbium (Yb), X' is a middle chalcogen (S, Se, or Te) or halogen, n is 0.002 to 0.2, and w is 1 when X' is halogen or 2 when X' is a middle chalcogen, b) a lanthanum oxybromides, c) a terbium-activated or thulium-activated gadolinium oxide or oxysulfides, or d) an alkaline earth metal phosphor that is the product of firing starting materials comprising optional oxide and a combination of species characterized by the following formula (2):

$$MFX_{1-z}I_zuM^aX^a:yA:eQ:tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Th), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni), "z" is 0 to 1, "u" is from 0 to 1, "y" is from $1\times10^{-4}$ to 0.1, "e" is form 0 to 1, and "t" is from 0 to 0.01.

10. The imaging assembly of claim 1 wherein said fluorescent intensifying screen support comprises a reflective substrate comprising a continuous polyester first phase and second phase dispersed within said continuous polyester first phase, said second phase comprised of microvoids containing inorganic particles.

11. The imaging assembly of claim 10 wherein said inorganic particles are barium sulfate particles.

12. The imaging assembly of claim 10 wherein the reflective index of said polyester first phase to said second phase is from about 1.4:1 to about 1.6:1, said microvoids occupy from about 35 to about 60% (by volume) of said reflective substrate, said reflective support has a dry thickness of from about 100 to about 400 nm, and the average barium sulfate particle size is from about 0.6 to about 2 $\mu$m and comprise from about 35 to about 65 weight % of the total substrate weight.

13. A radiographic imaging assembly that has a system speed of at least 1000 and comprises:

A) a symmetric radiographic silver halide film having a film speed of at least 900 and comprising a support that has first and second major surfaces, said radiographic silver halide film having disposed on said first major support surface, two or more hydrophilic colloid layers including a first silver halide emulsion layer, and having on said second major support surface, two or more hydrophilic colloid layers including a second silver halide emulsion layer, each of said first and second silver halide emulsion layers comprising tabular silver halide grains that have the same composition, independently an aspect ratio of from about 38 to about 45, an average grain diameter of at least 3.5 $\mu$m, and an average thickness of from about 0.08 to about 0.14 $\mu$m, and comprise at least 95 mol % bromide and up to 1 mol % iodide, both based on total silver in said grains, said film further comprising a protective overcoat on both sides of said support disposed over all of said hydrophilic colloid layers, wherein said tabular silver halide grains in said first and second silver halide emulsion layers are dispersed in a hydrophilic polymeric vehicle mixture comprising from about 5 to about 15% of deionized oxidized gelatin, based on the total dry weight of said hydrophilic polymeric vehicle mixture, and B) two fluorescent intensifying screens arranged on both sides of said film, the pair of screens having a screen speed of at least 600 and said screens having an average screen sharpness measurement (SSM) value that is at least 1.1 times that of reference Curve A of FIG. 4 at a given spatial frequency, and each screen comprising a terbium activated gadolinium oxysulfide phosphor capable of absorbing X-rays and emitting electromagnetic radiation having a wavelength greater than 300 nm, said phosphor being coated in admixture with a polymeric binder in a phosphor layer on a flexible polymeric support.

14. The imaging assembly of claim 13 wherein said flexible polymeric support comprises a reflective substrate comprising a continuous biaxially oriented polyester first phase and second phase dispersed within said continuous polyester first phase, said second phase comprised of microvoids occupying from about 35 to about 60% (by volume) of said reflective substrate, and said microvoids containing barium sulfate particles that have an average particle size of from about 0.06 to about 2 $\mu$m and comprise from about 35 to about 65 weight % of the total substrate weight.

15. The imaging assembly of claim 13 wherein said polyester first phase is biaxially oriented poly(1,4-cyclohexylene dimethylene terephthalate) or poly(ethylene terephthalate).

16. A method of providing a black-and-white image comprising exposing the radiographic silver halide film in the radiographic imaging assembly of claim 1 and processing said film, sequentially, with a black-and-white developing composition and a fixing composition.

17. A method of providing a black-and-white image comprising exposing the radiographic silver halide film in the radiographic imaging assembly of claim 13 and processing said film, sequentially, with a black-and-white developing composition and a fixing composition.

18. The method of claim 16 further comprising using said black-and-white image for a medical diagnosis.

* * * * *